United States Patent [19]

Yamashita et al.

[11] 3,952,701

[45] Apr. 27, 1976

[54] ELECTROSTATIC DEVELOPING APPARATUS

[75] Inventors: Keitarou Yamashita, Kamisato; Takafumi Aoyama, Kumagaya, both of Japan

[73] Assignee: Hitachi Metals, Ltd., Japan

[22] Filed: Nov. 5, 1974

[21] Appl. No.: 521,091

[52] U.S. Cl. ..... 118/637

[51] Int. Cl.[2] ..... G03G 15/08

[58] Field of Search..... 118/637; 117/17.5; 355/3 DD

[56] References Cited

UNITED STATES PATENTS

| | | | |
|---|---|---|---|
| 3,402,698 | 9/1968 | Kojima et al. | 118/637 |
| 3,419,884 | 12/1968 | Betts et al. | 118/637 |
| 3,455,276 | 7/1969 | Anderson | 118/637 |
| 3,626,898 | 12/1971 | Gawron | 118/637 |
| 3,828,730 | 8/1974 | Yamashita et al. | 117/17.5 |
| 3,839,992 | 10/1974 | Takahashi | 117/17.5 |

*Primary Examiner*—Mervin Stein
*Assistant Examiner*—Douglas Salser
*Attorney, Agent, or Firm*—Craig & Antonelli

[57] ABSTRACT

An electrostatic developing apparatus for developing an electrostatic latent image formed on an electrostatic copy paper according to a magnetic brush developing process is disclosed. In this electrostatic developing apparatus, there is formed a magnetic brush of developer on a non-magnetic cylinder between the non-magnetic cylinder and an electrostatic copy paper, the aforesaid non-magnetic cylinder being rotated around the outer periphery of a stationary permanent magnet having a plurality of developing magnetic poles so that the electrostatic copy paper is slidingly rubbed with the magnetic brush to provide a visible image for the electrostatic latent image.

10 Claims, 7 Drawing Figures

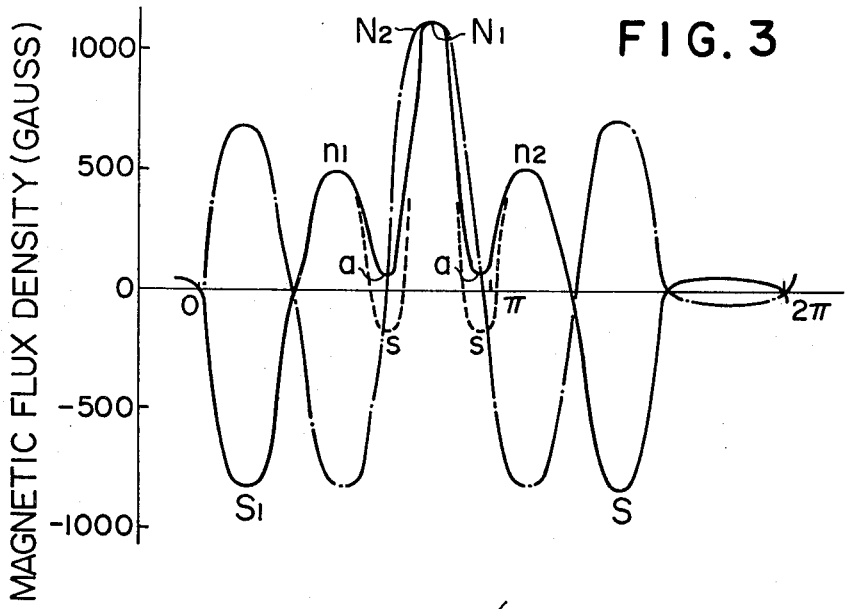
FIG. 3
FIG. 4 PRIOR ART
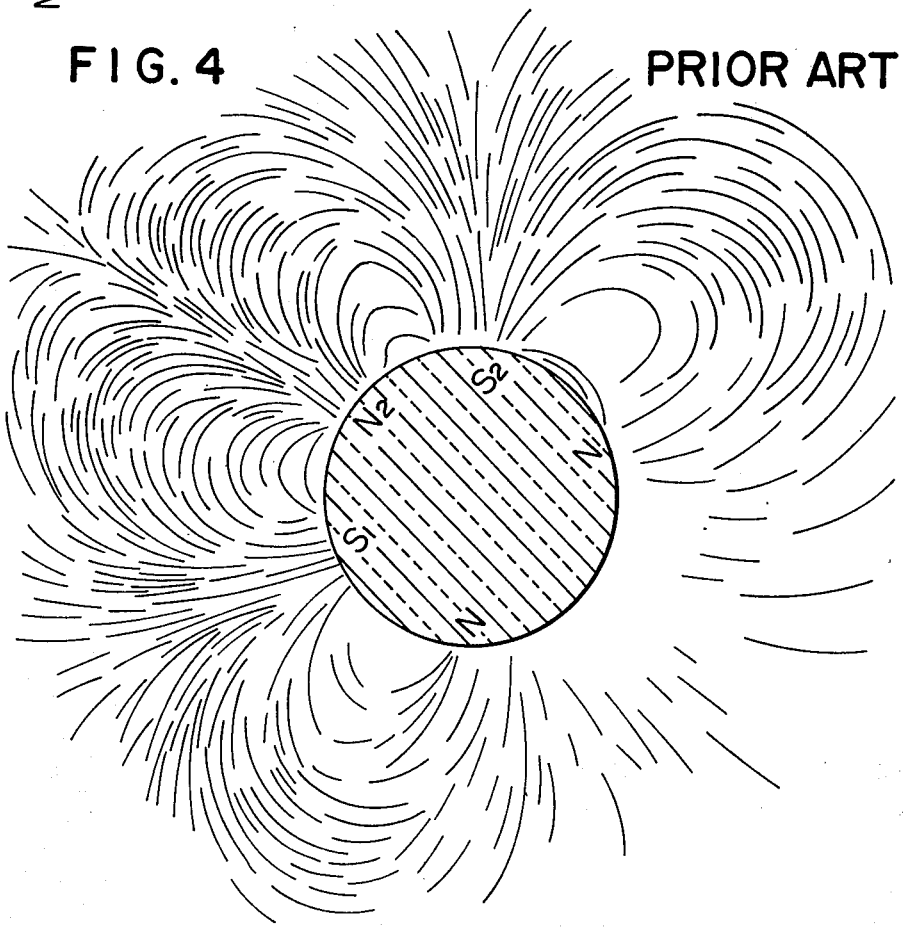

ELECTROSTATIC DEVELOPING APPARATUS

This invention relates to an electrostatic developing apparatus for developing an electrostatic latent image formed on a electrostatic copy paper by means of a magnetic brush.

According to the electrostatic developing apparatus, development is effected by electrostatically bonding developer or toner to the electrostatic latent image, which has been electrophotographically formed on an electrostatic copy paper of a layer of a light sensitive or photoconductive insulating material. Included by the developers which may be used herein are two component type developer consisting of a magnetic carrier and toner, and a single component type developer consisting of toner which exhibits ferromagnetism itself. In either case, a magnetic brush developing process is widely used, wherein the developer is attracted to the surface of a magnetic roll and transported to the position where the magnetic roll faces an electrostatic copy paper, and then forms a magnetic brush on the magnetic roll. The magnetic brush then rubs the surface of the electrostatic copy paper to thereby cause the developer or toner to adhere to the electrostatic latent image to provide a visible image thereon. Since the magnetic brush in such an electrostatic developing apparatus slidingly rubs the developing surface to develop an electrostatic latent image, it is required that the magnetic brush be erected on the surface of the magnetic roll and provide strength sufficient for such a purpose.

The magnetic roll used for such a developing apparatus is of such an arrangement that a rotating hollow, non-magnetic cylinder is disposed around the outer pheriphery of a permanent magnet which is of a rod type and fixed in position, so that an elongated magnetic pole is formed in the axial direction of the non-magnetic cylinder on the surface thereof, or may be such that a column type permanent magnet is rotated. The latter case is disclosed, for instance, in U.S. Pat. No. 3,455,276. The magnetic roll of this type has a plurality of elongated magnetic poles extending in the axial direction of but on the outer periphery of a column type permanent magnet, the magnetic poles having polarities N-S-N-S along the circumference of the permanent magnet.

With the developing apparatus using a magnetic roll, the strength and density of the magnetic brush formed in a developing portion, i.e., the position where the magnetic roll faces the electrostatic copy paper vary with the rotation of the magnetic roll. In other words, due to the rotation of the magnetic roll the magnetic pole portions and the inter-magnetic pole portions of the magnetic roll appear alternately in the developing portion thereon, so that the amount of toner which slidingly rubs the surface of the electrostatic copy paper varies with the rotation of the roll, thus failing to provide uniform developement. For this reason, there was required a mechanism for controlling the uneveness of developement for the developing apparatus of this type. In order to provide uniform developement, such an electrostatic developing apparatus that has a magnetic roll provided with a fixed permanent magnet and a non-magnetic cylinder adapted to rotate around the aforesaid permanent magnet was proposed and has been used. In this developing apparatus there has been arisen a demand for providing such a magnetic brush that is erected vertically of the surface of a magnetic roll thereon and has sufficient strength, and hence various improvements have been made to this end.

Among those improvements is a developing apparatus as disclosed in U.S. Pat. No. 3,402,698 of Kojima et al., in which there is provided a magnetic roll adapted to provide a magnetic brush of high strength. In this magnetic roll, there is provided a fixed permanent magnet assembly within a non-magnetic cylinder which is adapted to rotate therearound. Furthermore, in this permanent magnet, a main magnet acting as a developing magnetic pole is magnetized in the radial direction of the non-magnetic cylinder, while second magnets are attached to lateral sides of the main magnet and has magnetization in a second direction substantially perpendicular to the radial direction of the non-magnetic cylinder, the poles of the second magnets adjacent to the main magnet being of the same polarity as that of the active pole of the main magnet, so that the aforesaid active pole is adapted to produce a uniform magnetic field in front of the main magnet. The developing magnetic pole on the non-magnetic cylinder provides a magnetic force given by the second magnets in addition to the magnetic force by the main magnet in overlapping relation, thus providing a magnetic brush erected vertically of the surface of the magnetic roll and providing intense magnetic forces.

However, with the magnetic roll of this type, since subsidiary magnetic poles having an opposite polarity to that of the developing magnetic pole are located in the close vicinity of the developing magnetic pole, the magnetic fluxes issued from the developing magnet are attracted to the subsidiary magnetic poles, resulting in an extremely narrow width of a magnetic brush. The narrow width of the magnetic brush fails to provide a sufficient developing capability for the developing apparatus.

In addition, the second magnets to be attached to the lateral sides of the main magnet should be located in a manner that the same pole in the second magnetic pole is adjacent to the corresponding same pole of the main magnet thereby producing a strong repelling force. This provides considerable difficulty in assembling.

In addition, since the same poles face each other, the actuating point of the permanent magnet is lowered, thus failing to exhibit the magnetic characteristic sufficiently.

It is an object of the present invention to provide an electrostatic developing apparatus which provides a developing magnetic brush having a sufficient strength and a sufficient width and being vertical to the magnetic roll surface.

It is another object of the present invention to provide an electrostatic developing apparatus which provides a clear but uniform visible image.

According to the electrostatic developing apparatus of the present invention, a magnetic brush made of developer is produced in such a portion of the magnetic roll which faces the electrostatic copy paper, the aforesaid brush having a width and height sufficient for the development.

These and other objects and features of the present invention will be apparent from a reading of the ensuing part of the specification in conjunction with the accompanying drawings which indicate the preferred embodiments of the invention.

FIG. 3 is a graph showing the relationship between the positions of the magnetic roll with respect to its circumference and the density of the magnetic fluxes;

FIGS. 4 and 5 are views showing the magnetic fluxes around the outer peripheries of magnetic rolls according to the prior art and to the present invention, respectively.

Figure 1:
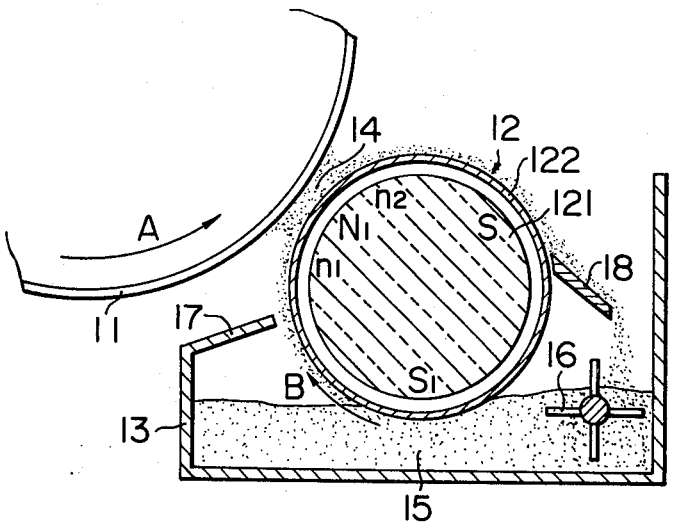
FIG. 1 is a cross-sectional view of the electrostatic developing apparatus according to the present invention.

The electrostatic developing apparatus according to the present invention consists of an electrostatic copy paper, a magnetic roll located in close vicinity of and parallel to the aforesaid copy paper and means for supplying developer to the magnetic roll at the opposite portion thereof to the copy paper, and is characterized in that the magnet roll consists of a fixed permanent magnet and a hollow, non-magnetic cylinder rotating around the permanent magnet, and that the permanent magnet has a plurality of elongated developing magnetic poles having a same polarity and extending parallel to the center line of the non-magnetic cylinder in a portion which faces the electrostatic copy paper.

According to the developing apparatus, the electrostatic copy paper moves relative to the magnetic roll, while the non-magnetic cylinder rotates relative to the fixed permanent magnet and a magnetic brush of developer is formed on the developing poles, that is, the position of the magnetic roll which faces the electrostatic copy paper so that the magnetic brush thus formed slidingly rubs the surface of the electrostatic copy paper to thereby provide a visible image. The developing magnetic poles having the same polarity according to the present invention must be at least two in number. When the developing magnetic poles having two or more poles of the same polarity are located adjacent to each other in the circumferential direction, the lines of magnetic forces extending from those magnetic poles in the radial direction of the magnetic roll tend to repel against each other and further extend in the radial direction, so that the magnetic brush formed of the developer on the poles may be strong and have a circumferential width equal to that of a plurality of magnetic poles.

According to the present invention, it is preferable that developing magnetic poles having the same polarity and adjacent to each other in the circumferential direction are three in number. In this case, the lines of magnetic forces from a center developing magnetic pole are repelled by the magnetic poles on the opposite sides thereof and hence tend to extend linearly in the radial direction, thereby forming a magnetic brush having a great height.

When the strongest magnetic pole among a plurality of developing magnetic poles having the same polarity is used as the main magnetic pole, and the other magnetic poles are disposed on both sides of the main magnetic pole as subsidiary magnetic poles, and when the magnetic flux density of the subsidiary magnetic field is 20 to 70% of that of the main magnetic pole, a magnetic brush thus obtained may be of the most suitable configuration. In case the magnetic flux density of subsidiary magnetic poles are less than 20%, the subsidiary magnetic poles may fail to enhance linearly extending the magnetic fluxes from the main magnetic pole, with the result that the magnetic brush formed may be smaller in size. On the other hand, if the magnetic flux density of subsidiary magnetic poles exceeds 70%, interference between the main magnetic pole and the subsidiary magnetic poles may arise, thereby presenting a condition which makes no difference between the main magnetic pole and the subsidiary magnetic poles.

It is preferable that there be no magnetic pole having opposite polarity between the adjacent developing magnetic poles having the same polarity.

If an intense magnetic pole having an opposite polarity is present between developing magnetic poles, then the lines of magnetic forces issued from the developing magnetic poles may be attracted to the magnetic poles having an opposite polarity, so that there may no longer be formed a magnetic brush. As a result, even if the magnetic poles having an opposite polarity are present between the developing magnetic poles, it is imperative that the magnetic forces of those magnetic poles having opposite polarity be smaller in its absolute value than those of the weakest magnetic pole of a plurality of developing magnetic poles.

More preferably, the magnetic forces of magnetic poles having an opposite polarity should be less than half the magnetic forces of developing magnetic poles.

Description will now be given of the electrostatic developing apparatus according to the present invention in conjunction with the embodiments of the invention.

The electrostatic developing apparatus according to the present invention, as shown in FIG. 1, consists of an electrostatic copy paper 11 of a drum type, a magnetic roll 12 disposed in the close vicinity of the electrostatic copy paper 11, and means for feeding developer 15 to the portion 14 confined between the electrostatic copy paper 11 and the magnetic roll 12.

The electrostatic copy paper 11 moves in the arrow direction A relative to the magnetic roll 12. The magnetic roll 12 consists of a fixed permanent magnet 121 and a hollow non-magnetic cylinder 122 rotating around the permanent magnet 121 in an arrow direction B. In this embodiment, the permanent magnet 121 is made of a ceramic magnet of a column form, for instance, of Ba ferrite magnet, and is coaxial with the non-magnetic cylinder 122.

Located within the permanent magnet 121 on the side facing the electrostatic copy paper 11 is a main magnet pole N1 for use in development, while subsidiary magnetic poles *n*1, *n*2 are positioned adjacent thereto. Those magnetic poles extend parallel to the center line of the permanent magnet 121. The main magnetic pole N1 and subsidiary magnetic poles *n*1 and *n*2 have the same polarity.

Developer 15 is placed in a tank 13 and attracted to the non-magnetic cylinder 122 due to the magnetic pole S1 of the permanent magnet 121 and then fed to the developing portion 14 facing the electrostatic copy paper 11, as the non-magnetic cylinder 122 rotates. In general, an impeller 16 is located within the tank 13 for agitating the developer 15, while there is provided a doctor blade 17 alongside of the non-magnetic cylinder 122 for adjusting the amount of the developer being fed. In addition, the developer which has completed development is scraped by means of a scraper 18 with the rotation of the non-magnetic cylinder 122 and returns into the tank 13. The magnetic flux density on the non-magnetic cylinder 122 of the magnetic roll 12 is distributed as shown by the solid line in FIG. 3. In this figure, the magnetic flux density shown in terms of the central angle of the magnetic roll is represented as an ordinate in Gauss. The curves of the subsidiary magnetic poles *n*1, *n*2 appear on the opposite sides of that of the main magnetic pole N1. As is clear from this figure, there is a small valley *a* of the magnetic flux density, between the developing magnetic pole N1 and subsidiary magnetic poles *n*1, *n*2, explaining that the subsidiary magnetic poles *n*1, *n*2 are independent of the main magnetic pole N1.

Figure 2:
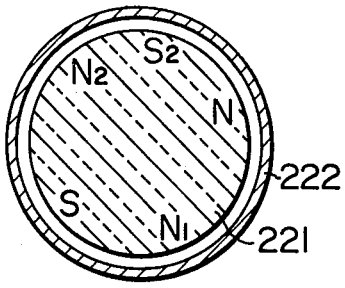
FIG. 2 PRIOR ART
FIG. 2 is a cross-sectional view of a magnetic roll of a conventional type.

The conventional magnetic roll as shown in FIG. 2 consists of a fixed permanent magnet 221 of a column form and a hollow non-magnetic cylinder 222 rotating around the outer periphery of the permanent magnet. In this figure, only N2 is a developing magnetic pole having one pole. The distribution of the magnetic flux density appearing on the non-magnetic cylinder 22 is shown by one point broken line in FIG. 3. The magnetic flux of the developing magnetic pole N2, as well, gives a simple sine curve as the magnetic fluxes of the other magnetic poles.

Figure 5:
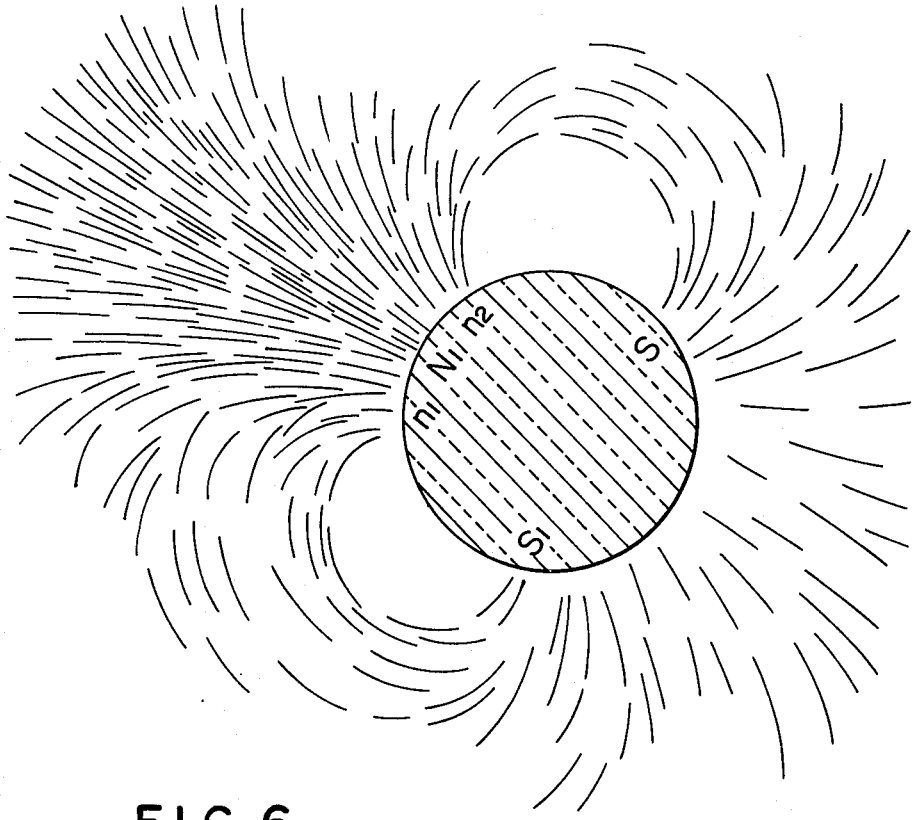

FIGS. 4 and 5 show the iron-powder patterns representing the distribution of the magnetic fluxes around the magnetic rolls of the conventional type and of the present invention. As shown in FIG. 5, there is created lines of the magnetic forces having a considerable width but perpendicular to the surface of the magnetic roll, by the main magnetic pole N1 and the subsidiary magnetic poles *n*1, *n*2 located on the opposite sides thereof. In contrast thereto, the lines of magnetic forces created on the conventional magnetic roll are distributed as shown in FIG. 4 in a manner that the lines of the magnetic forces extending from the developing magnetic pole N2 are attracted to the magnetic poles S1, S2, leaving a little part of the magnetic force lines which is perpendicular to the magnetic roll.

Figure 6:
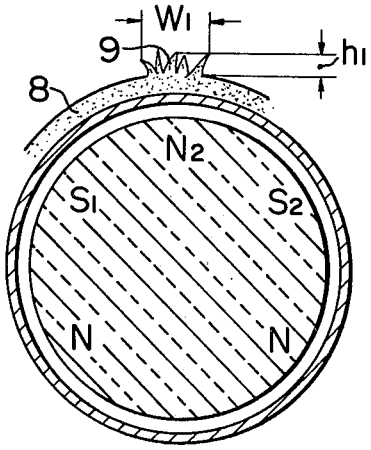
FIG. 6 PRIOR ART
FIGS. 6 and 7 are views showing magnetic brushes produced on the magnetic rolls of the prior art and of the present invention.
Figure 7:
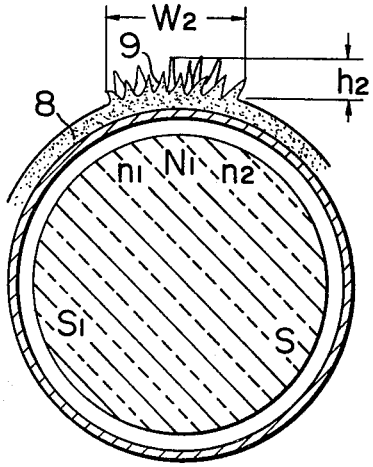

FIGS. 6 and 7 show the magnetic brushes formed due to the developer by using those magnetic rolls. There are formed magnetic brush 9 immediately above the developing magnetic pole but in a superposed relation to a layer of developer 8 having a uniform thickness. FIG. 6 refers to the magnetic roll shown in FIG. 2, illustrating decreased width W1 and height h1 of the magnetic brush 9. (The height as used herein refers to the height of the build-up portion of the developer from the surface of the layer of developer 8.) In constrast thereto, FIG. 7 refers to the magnetic roll according to the present invention as shown in FIG. 1, in which there are shown increased width W2 and height *h*2 of the build-up portion of magnetic brush 9, appearing like leaves of a pineapple. As shown, the width W2 and height *h*2 are considerably increased. The dimensions of the magnetic brush according to the prior art are: width W1 = 4 to 5 mm, and *h*1 = 2 to 3 mm, while those according to the present invention are: W2 = 9 to 11 mm, and *h*2 = 5 to 7 mm, presenting the dimensions twice those of the prior art.

As shown by the broken line in FIG. 3, even in case a small magnetic pole S is located between the developing magnetic poles N1, *n*1 and *n*2 of the magnetic roll 12, the lines of magnetic forces issued from the subsidiary magnetic poles *n*1, *n*2 are not completely absorbed in the magnetic pole S but contributes to the energization of the main magnetic pole N1, presenting a consistent effect, with the provision that the size of the magnetic pole S is smaller than those of the subsidiary magnetic poles *n*1, *n*2.

While in the above-mentioned embodiments there are shown three developing magnetic poles having the same polarity, two elongated magnetic poles of the same polarity can be used as developing magnetic poles in the electrostatic developing apparatus according to the present invention. The lines of the magnetic forces produced from those magnetic poles closely located may repel against each other to extend in the direction perpendicular to the surface of the magnetic roll, whereby a sufficient magnetic brush of developer is formed.

It is preferable that one of above-mentioned developing magnetic poles has more intense magnetic force than that of the other. In this case, the developing magnetic pole having more intense magnetic force opposes directly to an electrostatic copy paper having an electrostatic latent image formed thereon.

It is more preferable that a magnetic force of one magnetic pole among the developing magnetic poles closely located on the permanent magnet is 20 to 70 percent of that of the other one.

According to the present invention, there are closely located a plurality of magnetic poles having the same polarity, so that the lines of the magnetic forces produced from those magnetic poles may repel against each other to extend in the direction perpendicular to the surface of the magnetic roll. Thus, when the magnetic brush is formed with developer, the width and height of the magnetic brush are increased, presenting the so-called intense magnetic brush. Accordingly, when the electrostatic latent image formed on the electrostatic copy paper is rubbed with the magnetic brush thus formed, then developer of a sufficient amount will be attracted thereto, thus presenting a good visible image.

While in the preferred embodiments of the present invention, there is shown a developing magnetic pole having a N polarity, the developing magnetic pole having a S polarity gives the same effect. It is needless to mention that the number of magnetic poles to be provided on the surface of the magnet of a column type may be optionally selected, as required.

What is claimed is:

1. An electrostatic developing apparatus comprising:

an electrostatic copy paper having an electrostatic latent image formed thereon according to an electrophotographic process;

a hollow, non-magnetic cylinder which is rotatable and disposed in the close vicinity of said electrostatic copy paper;

a permanent magnet stationary within said hollow, non-magnetic cylinder, said permanent magnet having a plurality of elongated magnetic poles of the same polarity extending in the axial direction of said non-magnetic cylinder, in a portion adjacent to said electrostatic copy paper, said elongated magnetic poles being closely located whereby the lines of the magnetic forces produced from said elongated magnetic poles repel against each other and said elongated magnetic poles serve as developing magnetic poles;

means for supplying developer to a periphery of said hollow, non-magnetic cylinder;

means for moving said electrostatic copy paper in relation to said hollow non-magnetic cylinder; and means for rotating said hollow non-magnetic cylinder about its center around the outer periphery of said fixed permanent magnet;

whereby a magnetic brush having a large width in the circumferential direction is formed with developer on such a portion of said hollow, non-magnetic cylinder which faces said electrostatic copy paper, by means of the developing magnetic poles on said non-magnetic cylinder, and then the surface of said electrostatic copy paper is rubbed with said magnetic brush, as said electrostatic copy paper moves, thereby developing said electrostatic latent image to a visible image.

2. An electrostatic developing apparatus as set forth in claim 1, wherein the number of said elongated magnetic poles of the same polarity is three.

3. An electrostatic developing apparatus as set forth in claim 1, wherein the number of said elongated magnetic poles of the same polarity is three and a magnetic force of the central magnetic pole among the three magnetic poles is more intense than those of the other magnetic poles which are located on the opposite sides of said central magnetic pole.

4. An electrostatic developing apparatus as set force in claim 1, wherein the number of said elongated magnetic poles of the same polarity is three and the magnitude of magnetic forces of magnetic poles located sidewise is 20 to 70 percent of that of the central magnetic pole of the three magnetic poles.

5. An electrostatic developing apparatus as set forth in claim 1, wherein the number of said elongated magnetic poles of the same polarity is two.

6. An electrostatic developing apparatus as set forth in claim 1, wherein the number of said elongated magnetic poles of the same polarity is two and a magnetic force of one magnetic pole is more intense than that of the other magnetic pole.

7. An electrostatic developing apparatus as set forth in claim 1, wherein the number of said elongated magnetic poles of the same polarity is two and a magnetic force of one magnetic pole is 20 to 70 percent of that of the other magnetic pole.

8. An electrostatic developing apparatus as set forth in claim 1, wherein said permanent magnet is a solid member having said plurality of elongated magnetic poles serving as developing magnetic poles along the periphery thereof without poles of opposite polarity to said developing magnetic poles being closely spaced radially inwardly thereof.

9. An electrostatic developing apparatus comprising:

an electrostatic copy paper having an electrostatic latent image formed thereon according to an electrophotographic process;

a hollow, non-magnetic cylinder which is rotatable and disposed in the close vicinity of said electrostatic copy paper;

a permanent magnet stationary within said hollow, non-magnetic cylinder, said permanent magnet having three elongated magnetic poles of the same polarity extending in the axial direction of said non-magnetic cylinder, in a portion adjacent to said electrostatic copy paper, said elongated magnetic poles serving as developing magnetic poles, wherein at least one small magnetic pole of the opposite polarity to the developing magnetic poles is disposed between at least two developing magnetic poles, said small magnetic pole having a smaller magnetic force in its absolute value than those of the weakest magnetic poles among the developing magnetic poles;

means for supplying developer to a periphery of said hollow, non-magnetic cylinder;

means for moving said electrostatic copy paper in relation to said hollow non-magnetic cylinder; and means for rotating said hollow non-magnetic cylinder about its center around the outer periphery of said fixed permanent magnet;

whereby a magnetic brush having a large width in the circumferential direction is formed with developer on such a portion of said hollow, non-magnetic cylinder which faces said electrostatic copy paper, by means of the developing magnetic poles on said non-magnetic cylinder, and then the surface of said electrostatic copy paper is rubbed with said magnetic brush, as said electrostatic copy paper moves, thereby developing said electrostatic latent image to a visible image.

10. An electrostatic developing apparatus as set forth in claim 9, wherein the magnetic force of said small magnetic pole of the opposite polarity is less than half the magnetic forces of said developing magnetic poles.

* * * * *